United States Patent [19]

McKay

[11] Patent Number: 4,817,873

[45] Date of Patent: Apr. 4, 1989

[54] NOZZLES FOR IN-CYLINDER FUEL INJECTION SYSTEMS

[75] Inventor: Michael L. McKay, Willetton, Australia

[73] Assignee: Orbital Engine Company Proprietary Limited, Balcatta, Australia

[21] Appl. No.: 928,549

[22] Filed: Nov. 10, 1986

[30] Foreign Application Priority Data

Nov. 13, 1985 [AU] Australia ..... PH 03407

[51] Int. Cl.[4] ..... B05B 15/00; B05B 1/24; F02M 61/00

[52] U.S. Cl. ..... 239/397.5; 239/132.1; 239/139; 239/533.12

[58] Field of Search ..... 239/132.1, 132.3, 397.5, 239/533.12, 571, 139

[56] References Cited

U.S. PATENT DOCUMENTS

| | | | |
|---|---|---|---|
| 2,172,383 | 9/1939 | Honn | 239/132.1 |
| 2,896,856 | 7/1959 | Kravits | 239/132.1 |
| 4,394,970 | 7/1983 | Hoffman | 239/533 R X |
| 4,502,196 | 3/1985 | Kupper | 239/397.5 X |
| 4,669,660 | 6/1987 | Weber | 239/397.5 X |

FOREIGN PATENT DOCUMENTS

| | | | |
|---|---|---|---|
| 3404709 | 8/1985 | Fed. Rep. of Germany | 239/397.5 |
| 209422 | 4/1940 | Switzerland | 239/132.3 |
| 719952 | 12/1954 | United Kingdom . | |
| 759524 | 10/1956 | United Kingdom | 239/397.5 |
| 834826 | 5/1960 | United Kingdom . | |
| 1147021 | 4/1969 | United Kingdom . | |
| 2069045 | 8/1981 | United Kingdom . | |

*Primary Examiner*—Andres Kashnikow
*Assistant Examiner*—Patrick N. Burkhart
*Attorney, Agent, or Firm*—Armstrong, Nikaido, Marmelstein & Kubovcik

[57] ABSTRACT

A fuel injection nozzle for use in direct injection of fuel to an internal combustion engine, the injector nozzle comprising a body having a longitudinal fuel passage terminating in a port which in use communicate the fuel passage with the combustion chamber of the engine. A valve element to co-operate with a valve seat provided in the port to control fuel flow to the combustion chamber, and a fuel spray directing surface in the port extending downstream from the valve seat. The body including a cavity between the spray directing surface and that part of the body through which the fuel passage passes, with the cavity being shaped and located to restrict the area for conductive heat flow from the spray directing surface to fuel passage area of the body. The restriction of the heat flow maintains the spray directing surface at a temperature to combust particles of combustion products deposited thereon.

21 Claims, 3 Drawing Sheets

NOZZLES FOR IN-CYLINDER FUEL INJECTION SYSTEMS

This invention relates to the injecting of fuel into the combustion chamber of an internal combustion engine through a valve controlled port.

The characteristics of the spray of the fuel droplets issuing from a nozzle into a combustion chamber have major effects on the efficiency of the burning of the fuel, which in turn effects the stability of the operation of the engine, the engine fuel efficiency and the composition of the engine exhaust gases. To optimise these effects, particularly in a spark ignited engine, the desirable characteristics of the spray pattern of the fuel issuing from the nozzle include small fuel droplet size, controlled penetration of the fuel spray into the chamber, and at least at low engine loads, a relatively contained evenly distributed cloud of fuel droplets in the vicinity of the spark plug.

Some known injection nozzles, used for the delivery of fuel directly into the combustion chamber of an engine, are of the poppet valve type, from which the fuel issues in the form of a hollow divergent conical spray, with the fuel droplets forming a generally continuous conical wall extending from the peripheral edge of the poppet valve.

The nature of the shape of the fuel spray is dependent on a number of factors including the geometry of the port and valve constituting the nozzle, especially the surfaces of the port and valve immediately downstream of the seat where the port and valve engage to seal when the nozzle is closed. Once a nozzle geometry has been selected to give the required performance, relatively minor departures from that geometry can significantly repair the performance thereof. In particular the attachment or build-up of solid combustion products on surfaces over which the fuel flows is detrimental to the correct performance of the nozzle.

It is therefore an object of the present invention to provide a nozzle through which fuel is injected into a combustion chamber of an engine that will contribute to a reduction in the built up of solids.

With this object in view there is provided an internal combustion engine in-cylinder fuel injector nozzle comprising a body having a fuel passage therein, a port in the body to in use communicate the fuel passage with the engine combustion chamber, a valve element to co-operate with a valve seat in said port to control flow therethrough, a fuel spray directing surface in the port extending downstream from the valve seat, said body including means to regulate the heat flow through the body from the spray directing surface so that the latter is maintained at a temperature to combust particles of combustion products deposited thereon.

The means to regulate the heat flow is preferably arranged to restrict the conductive heat flow from the spray directing surface into that portion of the body adjacent the fuel passage. The fuel flow through the fuel passage provides a significant cooling effect on that part of the body surrounding said passage. Thus, that part of the body provides a substantial heat sink that would normally promote a flow of heat thereto from hotter parts of the body, including the fuel spray directing surface. Thus, interposing the regulation means between the spray directing surface and the heat sink provided by the fuel passage reduces the heat flow to the heat sink, and so limits the cooling effect thereof on the spray directing surface, to maintain that surface at a temperature to ignite solid combustion products that deposit thereon. In this way deposits do not accumulate on the flow directing surface to disturb the pattern of the fuel spray issuing from the port.

The control of the heat flow may be effected by providing a cavity in the body between the fuel directing surface and the fuel passage. The cavity may extend from a location close to the junction of the valve seat and the fuel spray directing surface a substantial distance through the body generally in the direction of the length of the fuel passage. In this form the cavity substantially lengthens the heat flow path between the spray directing surface and the cooled portion of the body about the fuel passage. Also this arrangement provides a preferred heat flow path from the spray directing surface to the cylinder head of the engine. As the cylinder head has a higher operating temperature than the portion of the nozzle body around the fuel passage, the rate of heat flow to the cylinder head is less and so contributes to maintaining the spray directing surface at the desired temperature.

The cavity provided in the injector nozzle body may be air filled to provide the insulation effect due to the low heat conductivity of air. Alternatively the cavity may be partially or wholly filled with a material, such as a ceramic, that has a substantially lower heat conductivity than the surrounding material of the body.

In order to further restrict the heat flow from the fuel spray directing surface, the body may be made of a low heat conductivity material, at least in that portion of the body between the spray directing surface and the heat flow control means. Stainless steel is a material having suitable properties including low heat conductivity for use in the portion of the body forming the spray directing surface.

In one embodiment the nozzle body comprises an inner portion through which the fuel passage extends and having the port end valve seat formed at one end of the fuel passage. The outer portion is located within an inner portion which forms the spray directing surface that extends downstream from the valve seat. The outer portion extends about the exterior of at least the part of the inner portion incorporating the valve seat and the fuel passage immediately upstream of the valve seat. The outer portion abuts the inner portion where the spray directing surface forms an extension downstream from the valve seat. However the area of abutment is small to provide only a narrow heat conductive transfer area. The outer portion is otherwise spaced from the inner portion to provide a cavity therebetween over at least a major part of the length of the fuel passage. Preferably the outer portion of the body is made of stainless steel and the inner portion may be made of stainless steel or a carbon steel.

Conveniently the valve element is constructed to co-operate with the spray directing surface of the body so that the fuel spray issuing from the nozzle is in the form of a generally circular shaped first array of fuel droplets and a second array of fuel droplets within the area defined by the first array.

Preferably the valve element is in the form of a poppet valve with the terminal edge portion provided with a plurality of notches spaced around the periphery. The provision of these notches provides two alternative paths for the fuel, an outer path formed by the unnotched portions of the terminal edge, and the other path formed by the bottom edge of the notches which are displaced radially inward from the terminal edge of the valve.

The surface of the valve over which the fuel passes when the valve is in the open position is preferably of a divergent conical form so that the fuel issuing from the terminal edge will initially maintain this direction of flow to form an outer array of fuel droplets. However where the terminal edge is interrupted by the notches wall attachment effects will cause at least some of the fuel presented to the notch to follow the surface of the base of the notch, and so issue from the valve inwardly of the terminal edge thereof.

Preferably the fuel supplied to the fuel passage is entrained in a gas, such as air, the gas being at a pressure sufficient to deliver the fuel into the combustion chamber of the engine when the valve is in the open position.

It is believed that the gas is more susceptible to the wall attachment effect than the fuel, and together with the effects of the surface tension of the fuel, this results in some shedding of fuel from the fuel-gas mixture at the initial edge of the notch. The shedded fuel is directed, by surface tension effects, to flow around the notches rather than through the notches, and so becomes entrained in and enriches the fuel-gas mixture flowing down the un-notched areas of the valve element. The fuel flowing down the un-notched area of the valve element is also guided by the spray directing surface.

The following description with references to the accompanying drawings, further explains the nature of the present invention as it may be incorporated into a known fuel metering and injection system.

Figure 1:
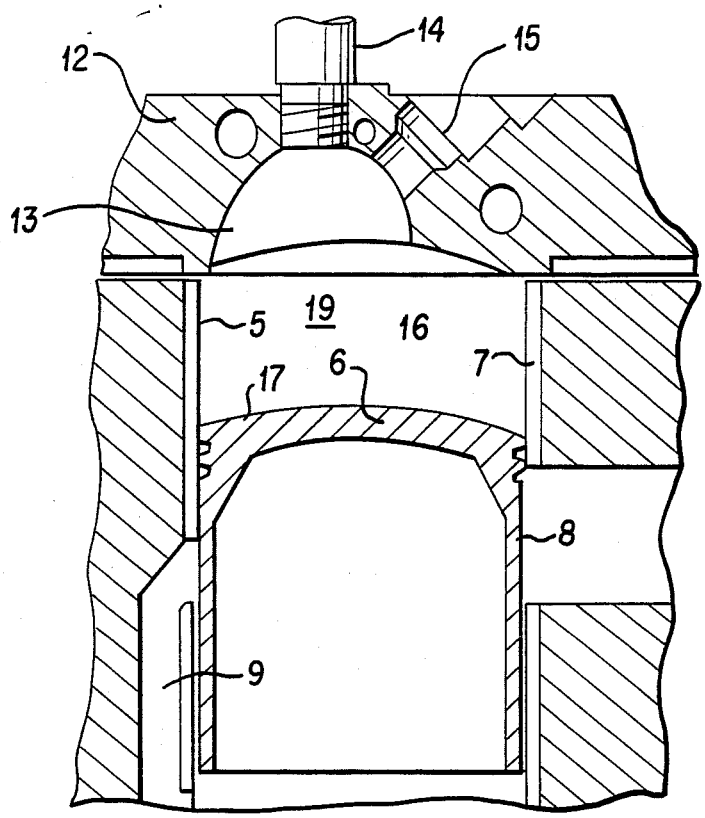
FIG. 1 shows portion of an engine in which the present invention may be incorporated.

FIG. 1 shows one cylinder of a spark-ignited direct fuel injected engine that operates on the two stroke cycle. Cylinder 5 has a piston 6 disposed therein to reciprocate in the axial direction of the cylinder in response to rotation of a crankshaft (not shown). The circumferential wall 7 of the cylinder has an exhaust port 8 and a diametrically opposed inlet or transfer port 9.

The upper end of the cylinder 5 is closed by a detachable cylinder head 12 having a cavity or bowl 13 formed therein in an eccentric disposition with respect to the cylinder axis. A fuel injector nozzle 14 is positioned at the top of the cavity, and an aperture 15 is provided for the receipt of a conventional spark plug. The head 17 of the piston 6 is slightly domed, and the opposing underface 16 of the cylinder head is of a complementary shape except for the provision of the cavity 13 therein. The head of the piston, cylinder head 12 and cylinder wall 7 together define combustion chamber 19.

Further details of the form of the cavity 13 and of the combustion process derived therefrom are disclosed in our British Patent Application No. 8612601 lodged on the 23rd May 1986 and the corresponding United States patent application No. 866727 lodged on the 26th May 1986.

Figure 2:
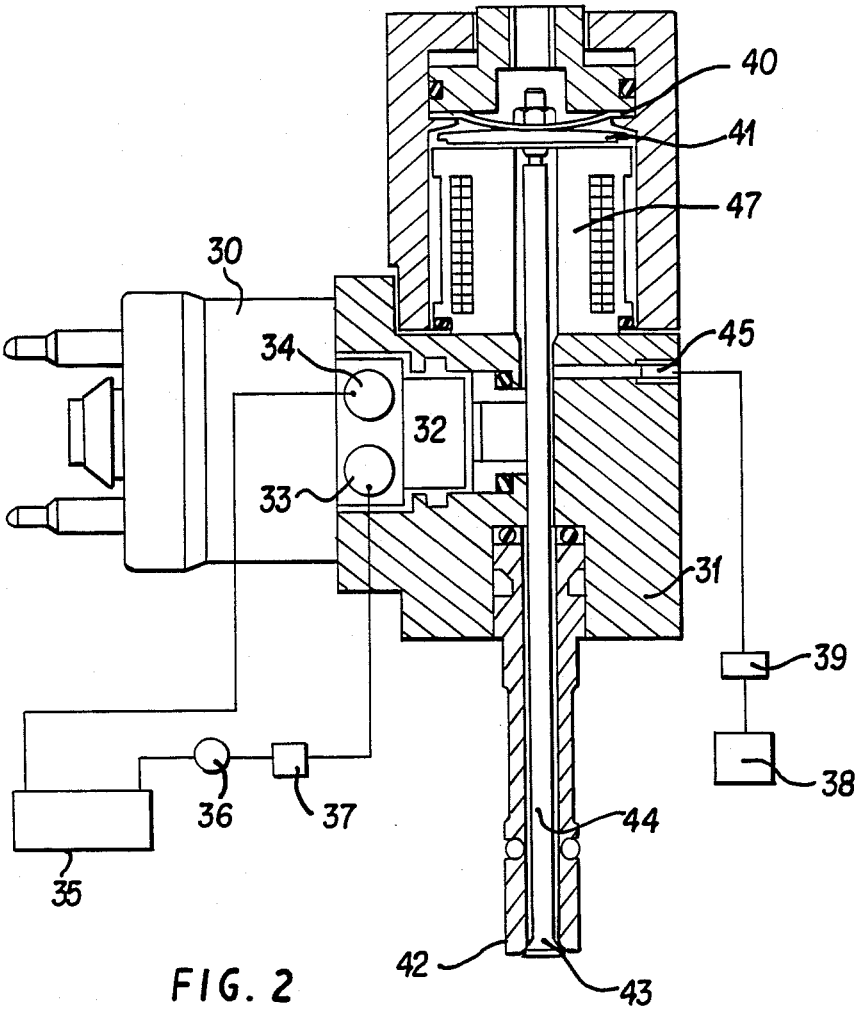
FIG. 2 shows a fuel metering and injection unit of the type suitable for use with the nozzle of the invention.

The injector nozzle 14 is an integral part of the fuel metering and injection system whereby fuel entrained in air is delivered to the combustion chamber of the engine by the pressure of an air supply. One particular form of fuel metering and injection unit is illustrated in FIG. 2 of the drawings.

The fuel metering and injection unit incorporates a suitable fuel metering device 30, such as a commercially available automobile type throttle body injector, coupled to an injector body 31 having a holding chamber 32 therein. Fuel is drawn from the fuel reservoir 35 and delivered by the fuel pump 36 via the pressure regulator 37 through fuel inlet port 33 of the metering device 30. The metering device, operating in the known manner, meters an amount of fuel into the holding chamber 32 in accordance with the engine fuel demand. Excess fuel supplied to the metering device is returned to the fuel reservoir 35 via the fuel return port 34. The particular construction of the fuel metering device 30 is not critical to the present invention and any suitable device may be used.

In operation, the holding chamber 32 is pressurised by air supplied from the air source 38 via the pressure regulator 39 through the air inlet port 45 in the body 31. The injector valve 43 is actuated to permit the pressurised air with the metered amount of fuel therein to be discharged through injector port 42 into a combustion chamber of the engine. Injector valve 43 is of a poppet valve construction opening inwardly to the combustion chamber, that is, outwardly to the holding chamber. The portion of the body 31 incorporating the valve 43 and port 42 is shown in detail in FIG. 3 and for the sake of clarity many details that appear in FIG. 3 are omitted from FIG. 2.

The injector valve 43 is coupled, via the valve stem 44, which passes through the holding chamber 32, to the armature 41 of the solenoid 47 located within the injector body 31. The valve 43 is biased into the closed position by the disc spring 40 and is opened by energising the solenoid 47. Energising of the solenoid 47 is controlled in time relation to the engine cycle to effect delivery of the fuel from the holding chamber 32 via the valve 43 to the engine combustion chamber.

Further details of the operation of the fuel injection system incorporating a holding chamber is disclosed in Australian Patent Application No. 32132/84 and corresponding U.S. patent application Ser. No. 740067 filed on the 2nd Apr. 1985. The disclosures of these two applications are each incorporated herein by reference.

Figure 3:
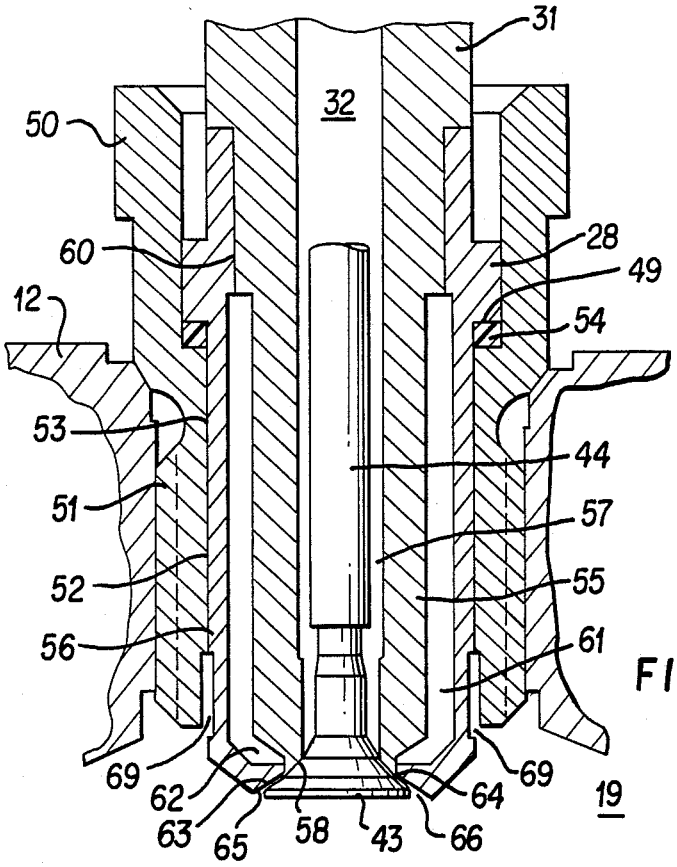
FIG. 3 shows to an enlarged scale the nozzle portion of the fuel metering and injection unit shown in FIG. 2.

Referring now to FIG. 3 there is shown to an enlarged scale the nozzle portion of the metering and injector unit described with reference to FIG. 2, with the assembly in the cylinder head 12 of the engine shown in FIG. 1. The adaptor sleeve 50 is threadably received at 51 in the aperture 14 provided in the cylinder head 12 and the nozzle portion 28 of the injector body 31 has the external surface thereof 52, a sliding fit in the bore 53 of the adaptor sleeve 50. A suitable compression seal 54 is provided between the shoulder 49 of the nozzle portion 28 and the adaptor sleeve 50 to seal therebetween against the escape of gas from the combustion chamber. Preferably the seal 54 is made of a high heat conductive material to provide an efficient heat flow path from the body 31 to the sleeve 50 and hence to the cylinder head 12.

The nozzle portion 28 includes two concentrically arranged sections hereinafter referred to as the inner section 55 and the outer section 56. The inner section 55 has a central bore 57 extending therethrough which constitutes a portion of the holding chamber 32 previously referred to, and terminates at the lower extremity with a tapered valve seat 58. Co-operating with the valve seat 58 is the poppet type nozzle valve 43 attached to the lower end of the valve stem 44.

The outer section 56 is of a generally cylindrical form, so as to enclose the lower end of the inner section 55, and is an interference fit at 60 with the inner section 55 to provide an integral assembly with good heat transference. The internal diameter therebetween of the outer section 56 is greater than the external diameter of the inner section 55 so that when assembled as above described an annular cavity 61 is formed therebetween. In the pratical form of the nozzle the bore 57 through which the fuel passes is of a diameter of about 3.5 mm and the cavity 61 is of a radial width of about 1 mm.

At the lower end, the outer section 56 extends at 63 beneath the lower end of the inner section 55 to abut, at 64, the inner section 55 adjacent the lower end of the valve seat 58. The extending portion 63 of the outer section 56 is spaced downwardly from the end of the inner section 55 so that the cavity 61 extends laterally inwardly towards the valve seat 58 as seen at 62.

The inwardly extending portion 63 has an tapered bore portion 65 which generally forms an extension of the lower end of the valve seat 58, but is of a slightly larger diameter so as to provide an annular passage 66 between the valve 43 and the extending portion 63 of the outer section 56 when the valve is closed seated on the seat 58.

The shape of the annular passage 66, including the contour of the respective surfaces forming the opposite walls thereof, has a significant influence on direction of the spray issuing from the injector nozzle into the combustion chamber 19 of the engine. Any change from the original designed shape of the passage or contour of the respective surfaces forming same, may substantially alter the spray pattern of the fuel, and hence alter the combustion process, resulting in variations in the efficiency of combustion and the nature and amount of emissions contained in the exhaust gases. Accordingly once the shape of the passage and the contour of the surfaces has been settled it is important to ensure that these do not change in an uncontrolled or unpredictable manner.

As is known carbon deposits and other solid particle deposits build up on the internal surfaces of the combustion chamber of an engine, and accordingly, such deposits may also build on up exposed surfaces of the injector nozzle, and in particular on the surfaces above discussed which define the passage 66. The present invention controls the temperature of these surfaces by regulating the rate of heat flow therefrom so that the surfaces are maintained at a temperature sufficiently high to ensure combustion of any carbon or other deposits which may settle on the surfaces under normal operation of the engine.

It is known that, in a gasoline engine, preignition of the combustion charge is likely to occur if that charge is exposed to a surface having a temperature of the order of 900° C. or above. It is equally known that carbon particles that may be formed in the engine will not combust at temperatures below about 450° C. Accordingly it is desirable to maintain the surfaces of the nozzle which define the passage 66 at temperatures between the ignition point of the carbon particles and the temperature of pre-ignition of the fuel. Preferably, the temperature should be towards the upper end of that range such as in the range of 800°–850° C.

With similar injector nozzles, prior to the present invention, it has been discovered that of the two surfaces defining the passage 66 the tapered bore portion 65 of the outer section 56 is subject to the greater cooling effect, as it is an integral part of the injector body, which is subject to cooling by the passage of the fuel and air mixture therethrough, and also from its contact via sleeve 50 with the cylinder head of the engine, and to a lesser extent by radiation from the upper parts of the injector body that are located in free air.

In the above description the annular cavity 61 between the inner and outer sections 55 and 56 provides a heat transfer barrier or insulating effect for the tapered portion 65 so that there is not a rapid flow of heat from that surface into the remainder of the body of the nozzle. In particular the cavity 61 restricts the heat flow into the inner section 55 adjacent to the holding chamber 32 in which the fuel-air mixture is contained. The only direct contact between the inner and outer sections in the vicinity of the tapered bore portion 65 is the relatively small abutment area at 64 immediately adjacent the valve seat 58 and through the engagement of the two components in the relatively remote area 60. As the area is physically displaced from the tapered bore portion 65 a distance substantially greater than that surface is displaced from the cylinder head of the engine, there will be a natural preference for the heat to flow from the surface of the tapered bore 65 to the cylinder head rather than the greater distance up to the area of interference engagement at 60 between the inner and outer sections.

The control of the rate of heat flow from the surface of the tapered bore portion 65 can be contributed to by making the outer section 56 of stainless steel which has a conductivity of the order of 14–16 watts/meter° C. This rate of conductivity is substantially less than that of normal carbon steels which may be in the range of 45–58 watts/meter° C. The control of rate of heat flow may be assisted by at least partially filling the cavity 61 with an insulating material such as a ceramics material.

Further assistance in controlling the rate of heat flow is provided by a clearance area between the outer section 56 and the sleeve 50 as indicated at 69 so that there is a heat flow into the outer section of this area from the combustion gases. The temperature in the area 69 will influence the rate of heat flow from the portion 63 of the outer section 56 and so assist in maintaining the required temperature of the tapered portion 65.

In addition, or alternatively, the heat flow into the outer section 56 from the combustion gases may be varied by varying the degree of penetration of the nozzle into the combustion chamber 19 beyond the inner end of the sleeve 50. Appropriate testing will determine the preferred nozzle penetration for a particular engine configuration and operationing conditions, and that may then be set as the standard for such engines.

Figure 5:
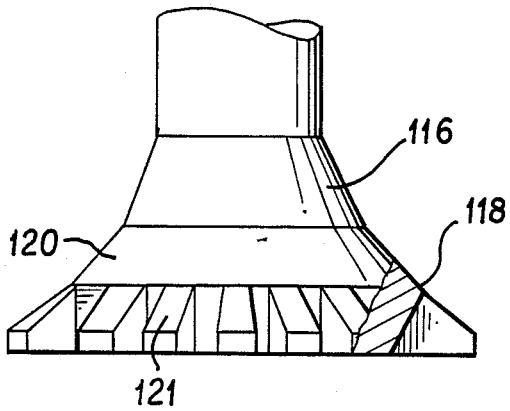
FIG. 5 shows a side elevation view of the poppet valve shown in FIG. 4.
Figure 4:
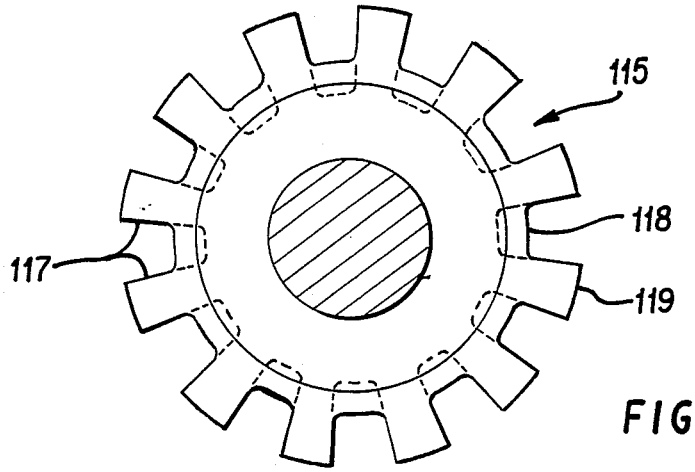
FIG. 4 shows a plan view of poppet valve suitable for use in the nozzle of FIG. 3.

FIGS. 4 and 5 shows respective plan and side views of a poppet valve intended to be used as a nozzle valve in the injector unit shown in FIG. 3. As can be seen from the plan view of the valve, there are twelve equally spaced notches or slots 115 about the periphery of the head 116 of the poppet valve, and an annular sealing face 120 which in use co-operates with the valve seat 58 in FIG. 3. The included angle of the sealing face is 90° but may be at any other appropriate angle such as, for example, the sometimes used 120° angle. In the embodiment shown the annular portion 121 of the poppet valve head, in which the notches 115 are provided, has a greater included angle of 120°. Thus with this poppet valve the surface 65 of the port would have to be similarly inclined at an included angle of 120°.

The included angle between the opposite radial walls of the notch is 14.1/2°, the overall diameter of the valve head is 5.5 millimeters with the width of the notch at the periphery of 0.6 millimeters. It is to be noted the depth of the notch is such that it does not extend into the sealing face 120 of the valve.

In the embodiment shown the side walls 117 of the notches are radial to the axis of the valve and the base 118 of each notch is inclined so that the depth of the notch at the lower face of the valve is greater than at the upper face. Typically the angle of the inclined base to the axis of the valve may be of the order of 30°.

Further disclosure in regard to the construction and operation of the valve shown in FIGS. 4 and 5 modifications thereof are provided in our International Patent Application No.PCT/AU86/00201. Those disclosures are incorporated in and made part of this specification by reference.

It is to be understood that the passage 66 between the valve 43 and tapered portion 65 of the outer section 56 may be of a cylindrical form as an alternative to the divergent conical form shown in FIG. 3. In the cylindrical form the conical form of the valve 43 would be shortened to the length necessary to provide a sealing face with the port face 58 but to not extend significantly therebeyond.

The fuel injector nozzle as disclosed herein may be used in a wide range of fuel injection systems for gasoline engines, including such engines for use in vehicles and marine craft including automobile engines and outboard marine engines.

The claims defining the invention are as follows:

1. An internal combustion engine in-cylinder fuel injection nozzle comprising a body having a fuel passage therein, port means at one end of the body for in use communicating the fuel passage with an engine combustion chamber, a valve seat in said port means, valve element means selectively openable outward with respect to the body for co-operating with the valve seat to control fuel flow from the fuel passage to the engine combustion chamber, fuel directing surface means in the port means extending down stream from and adjacent to the valve seat for directing the fuel passing through the port means in a defined path into the combustion chamber, and member means for maintaining the fuel directing surface means in use at an elevated temperature to combust particles of combustion products deposited thereon, said fuel directing surface means being formed on said member means, said member means also for contacting the body about the periphery of and proximate to the valve seat by an area of reduced thickness to provide a minimal heat transfer path between the body and member means.

2. An internal combustion engine in-cylinder fuel injector nozzle comprising a body having a fuel passage therein, a port at one end of the body to in use communicate the fuel passage with an engine combustion chamber, a valve seat in said port, a valve element adapted to co-operate with the valve seat and selectively openable outward with respect to the body to control fuel flow from the fuel passage to the engine combustion chamber, and a fuel directing surface in the port extending downstream from the valve seat to direct the fuel passing through the port in a defined path into the combustion chamber, said fuel directing surface being formed on a member defining with the body an insulating cavity surrounding the body and extending from the port a substantial distance along the body in the direction of the fuel passage, said member contacting the body about the periphery of the valve seat to isolate the cavity from the combustion chamber wherein it is used and to provide a minimal heat transfer path between the body and member so the fuel directing surface is maintained at an elevated temperature to combust particles of combustion products deposited thereon.

3. A fuel injection nozzle as claimed in claim 2 wherein the valve seat and the fuel-directing surface are each co-axial with that portion of the fuel passage immediately upstream of the valve seat, and the cavity is annular and co-axial with the fuel passage, and extending from a first location radially outward of the fuel-directing surface to a second location radial outward of the fuel passage and axially upstream from the valve seat.

4. A fuel injector nozzle as claimed in claim 2 or 3 wherein the cavity is filled with gas.

5. A fuel injector nozzle as claimed in claim 2 or 3 wherein the cavity is at least partially occupied by an insulating material.

6. A fuel injector nozzle as claimed in claim 5 wherein the insulating material is a ceramic.

7. A fuel injector nozzle as claimed in claim 2 wherein the body comprises an inner portion through which the fuel passage extends and having the port and valve seat at the end of the inner portion, and the member extends about at least that part of the inner portion of the body incorporating the valve seat and the fuel passage immediately upstream of the valve seat, said member forming the spray directing surface and with the inner portion of the body defining therebetween the cavity.

8. A fuel injector nozzle as claimed in claim 7 wherein the inner portion of the body has a first annual terminal face extending from the downstream end of the valve seat and the member has a second annual terminal face extending from the upstream end of the spray directing surface, said first and second surfaces being in a substantially abutting relating with a restricted area for conductive heat flow therebetween.

9. A fuel injector nozzle as claimed in claim 7 or 8 wherein the cavity is co-axial with the fuel passage and port with an inner cylindrical wall formed by an external surface of the inner portion of the body and an outer cylindrical wall formed by an internal surface of the member.

10. A fuel injector nozzle as claimed in claim 8 wherein the cavity is of a substantially annular cross-section co-axial with the fuel passage and defined by opposing surfaces of the inner portion extending inwardly to the location where the first and second surface abut.

11. A fuel injector nozzle as claimed in 2, 3, 7 or 8 wherein the member is made of a material of low heat conductivity compared with carbon steel.

12. A fuel injector nozzle as claimed in claim 2, 3, 7 or 8 wherein the member is made of stainless steel.

13. A fuel injector as claimed in claim 7 or 8 wherein the cavity is at least partially occupied by an insulating material.

14. A fuel injector as claimed in claim 13 wherein the insulating material is a ceramic.

15. An internal combustion engine in-cylinder fuel injector nozzle comprising a body having a fuel passage therein, a port at one end of the body to in use communicate the fuel passage with an engine combustion chamber, a valve seat in said port, a valve element adapted to co-operate with the valve seat and selectively openable outward with respect to said body to control fuel flow from the fuel passage to the engine combustion chamber, a separate member surrounding that portion of the body wherein the port is formed to form an insulating cavity about the port, said separate member also forming an annular fuel directing surface co-axial with the port and extending from the valve seat in the direction downstream thereof, said cavity extending from the level of the port upstream about the body with a portion of the external surface of the member being dimensioned to be spaced from a surrounding surface of the engine cylinder when the injector nozzle is installed therein to provide therebetween a gap to thereby extend the length of the heat flow path from the fuel directing surface to said surrounding surface of the engine cylinder, said member contacting the body about the periphery of the valve seat to isolate the cavity from the combustion chamber wherein it is used and provide a minimal heat transfer path between the body and member so the fuel directing surface is maintained at an elevated temperature to combust particles of combustion products deposited thereon.

16. An internal combustion engine having an in-cylinder fuel injector nozzle as claimed in 2, 3 or 15.

17. An internal combustion engine being an engine for a vehicle and having an in-cylinder fuel injector nozzle as claimed in 2, 3 or 15.

18. An internal combustion engine being an engine in or for an automobile and having an in-cylinder fuel injector nozzle as claimed in claim 2, 3 or 15.

19. An internal combustion engine being a marine engine and having an in-cylinder fuel injector nozzle as claimed in claim 2, 3 or 15.

20. An internal combustion engine being an outboard marine engine and having an in-cylinder fuel injector nozzle as claimed in claim 2, 3 or 15.

21. An internal combustion engine in-cylinder fuel injector nozzle comprising a body having a fuel passage therein, port means at one end of the body for in use communicating the fuel passage with an engine combustion chamber, a valve seat in said port means, valve element means selectively openable outward with respect to the body for co-operating with the valve seat to control fuel flow from the fuel passage to the engine combustion chamber, separate member means surrounding at least that portion of the body wherein the port means is formed for forming an insulating cavity about the port means and for forming an annual fuel directing surface co-axial with the port means and extending from the valve seat in a direction downstream thereof, said cavity extending from the level of the port means upstream about the body with a portion of the external surface of the member means being spaced from the surrounding surface of the engine cylinder when the injector nozzle is installed therein to provide therebetween a gap to thereby extend the length of the heat flow path from the fuel directing surface to the engine cylinder surround surface, said member means contacting the body about the periphery of the valve seat to isolate the cavity from the combustion chamber wherein it is used, said member means for maintaining the fuel directing surface at a temperature high enough to combust particles of combustion products deposited thereon by providing a minimal heat transfer path between the member means and the body.

* * * * *

UNITED STATES PATENT AND TRADEMARK OFFICE

CERTIFICATE OF CORRECTION

PATENT NO. : 4,817,873

DATED : April 4, 1989

INVENTOR(S) : Michael L. McKAY

It is certified that error appears in the above-identified patent and that said Letters Patent is hereby corrected as shown below:

Column 8, lines 51 to 56, Claim 10 should read as follows:
--10. A fuel injector nozzle as claimed in claim 8 wherein the cavity is of a substantially annular cross-section co-axial with the fuel passage and defined by opposing surfaces of the inner portion of the body and of the member, and includes a portion extending inwardly to the location where the first and second surface abut.--.

Signed and Sealed this

Twenty-seventh Day of March, 1990

*Attest:*

JEFFREY M. SAMUELS

*Attesting Officer*

*Acting Commissioner of Patents and Trademarks*